United States Patent [19]

Reymont

[11] 4,314,600

[45] Feb. 9, 1982

[54] APPARATUS FOR GUIDING AND SUPPORTING A CONTINUOUSLY CAST SLAB

[75] Inventor: Bertrand Reymont, Zürich, Switzerland

[73] Assignee: Alfred Wertli Inc., Winterthur, Switzerland

[21] Appl. No.: 131,128

[22] Filed: Mar. 17, 1980

[30] Foreign Application Priority Data

Apr. 4, 1979 [DE] Fed. Rep. of Germany ..... 2913440

[51] Int. Cl.[3] ..... B22D 11/00

[52] U.S. Cl. ..... 164/448; 164/442; 193/35 R; 193/1; 198/580; 198/779

[58] Field of Search ..... 164/442, 448, 82; 226/185, 189, 190; 193/35 R, 1; 198/472, 580, 779, 788

[56] References Cited

U.S. PATENT DOCUMENTS 3,283,368 11/1966 Homan ..... 164/442 X

FOREIGN PATENT DOCUMENTS 437659 4/1967 Fed. Rep. of Germany ..... 164/448

307966 1/1969 Sweden ..... 198/779

*Primary Examiner*—Gus T. Hampilos

*Attorney, Agent, or Firm*—Kenyon & Kenyon

[57] ABSTRACT

The continuous casting installation is provided with freely rolling rollers which can be releaseably coupled to drive motors to impart a pushing force on the moving slab. The drive motors are mounted on slides which are reciprocated by a piston-cylinder unit. Also, each drive motor can be reciprocated toward and away from a facing roll by another piston-cylinder unit.

7 Claims, 5 Drawing Figures

APPARATUS FOR GUIDING AND SUPPORTING A CONTINUOUSLY CAST SLAB

This invention relates to an apparatus for the continuous casting of a slab. More particularly, this invention relates to an apparatus for propulsion or retarding of a continuously cast metal slab.

The continuous casting installation described in U.S. Pat. application Ser. No. 131,115, filed Mar. 17, 1980 has been provided with a plurality of freely rolling rollers for the guiding and supporting of a continuously cast slab. The function of these rollers is to form the crust of the soft slab and in the process of solidification, to form the whole slab. These free rollers require no bearing that might be destroyed and insure that every point on the slab surface remains acceptable to cooling water for cooling of the freshly cast slab so that no local overheating can occur. Being supported at many points by the supporting structure, these free rollers do not have bending problems. Hence, the continuous casting installation of the above type has important advantages, particularly, if care is taken to have the distance between the individual rollers maintained constant and to have the rollers maintained in parallel.

However, a problem arises in these installations in the manner in which the slab is withdrawn. Normally, driven fixed extraction rollers are arranged in a region where the slab becomes horizontal (end of solidification). Since no more Ferro-static pressure is present at this point, it is necessary to press these extraction rollers against the slab with very great force as the coefficient of friction between the surface of the rollers made normally of steel and the slab surface, is much lower than 1.0 (about 0.4). As tests have shown, the required forward pulling force may be up to 80 tons. Normally, the press-on forces are in the order of magnitude of 150 to 200 tons. Such extreme force conditions require extremely strong feed devices which are, accordingly, complex in construction and expensive in manufacture and maintenance.

From the technical point of view, instead of extracting the slab from the casting installation from the end, it would be desirable to distribute the forward pushing forces along the entire slab. This, however, causes considerable difficulties in practice and requires major expense since several or all of the supporting rolls would have to be driven. Further, any irregularities in the slab advance due to the inevitable play in the force transmission elements and a relatively rapid wearing would have to be accepted.

In continuous casting installations where freely rolling rolls are used, the above problems become even more serious as a direct drive of the rolls, for example, by chains, drive belts or the like is not possible. Thus, it has been necessary until now to adopt the technically less satisfactory method of "extraction" of the slab.

Accordingly, it is an object of the invention to provide a relatively simple means of driving a continuously cast slab along its length.

It is another object of the invention to provide a reliable means of driving a continuously cast slab.

It is another object of the invention to provide a relatively simple reliable means for driving freely rolling rolls along a support surface of a continuous casting installation.

Briefly, the invention is directed to an apparatus for guiding and supporting a continuously cast slab. The apparatus is comprised of a support surface, a plurality of rolls disposed on the support surface in freely rolling relation to guide a slab therealong and a drive means disposed along at least one side of the support surface for releaseably engaging and rotating at least one of the rolls. The drive means allows the slab to be driven uniformly and along a major portion of the slab length. Further, the drive means can be constructed in a simple and inexpensive manner and can be operated in a reliable and safe manner.

The drive means may be constructed of one or more slides which are slidably mounted on a rail disposed along a side of the support surface and a plurality of drive motors which are mounted on each slide for selective coupling with selected ones of the rolls. In addition, the drive means includes a means connected to each motor for moving each motor towards and away from the rolls in order to effect a coupling and de-coupling relationship with the rolls.

These and other objects and advantages of the invention will become more apparent when taken in conjunction with the accompanying claims and appended drawings in which:

FIG. 1 schematically illustrates a side view of a continuous casting installation constructed in accordance with the invention;

Figure 1:
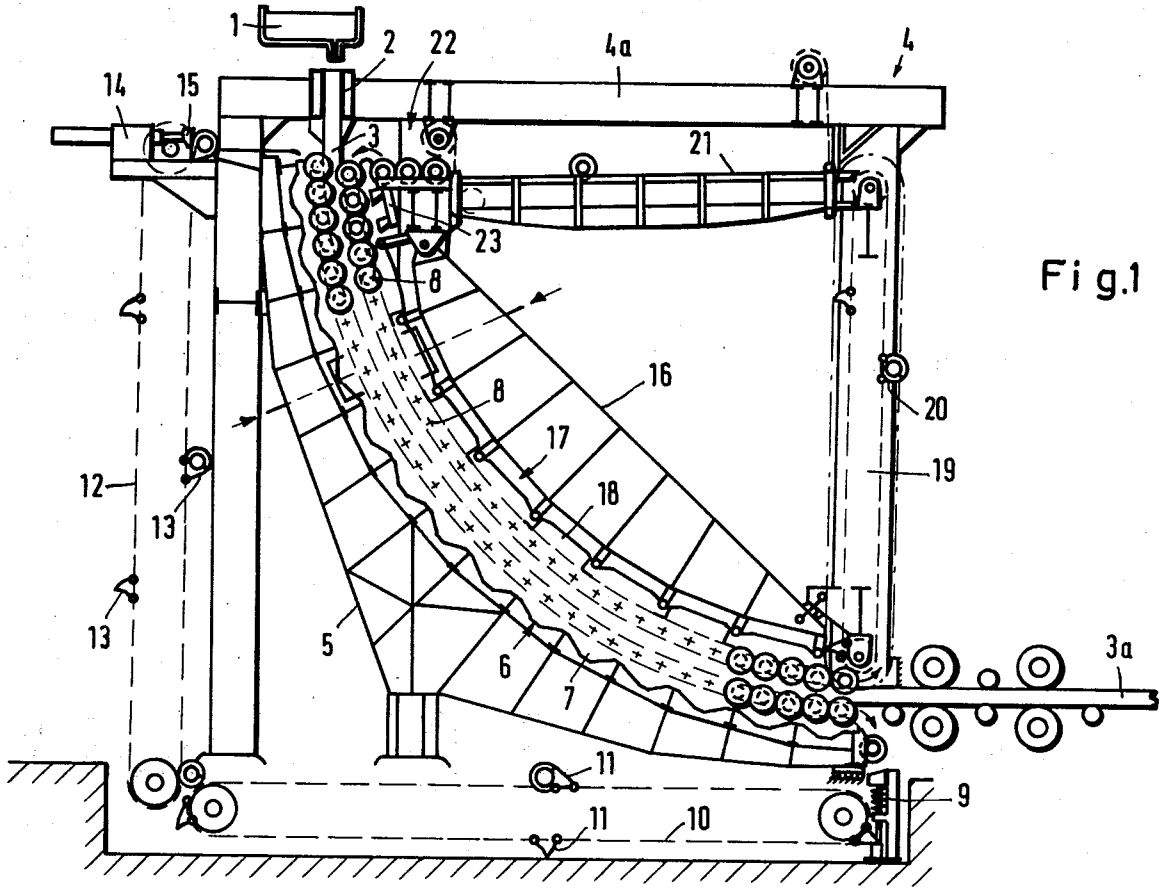

Referring to FIG. 1, the continuous casting installation includes a frame 4 which has an upper cross beam 4*a* which carries a chill mold 2 for receiving a liquid metal 1. The chill mold 2 serves to form a slab 3 of the metal which emerges at the lower end of the mold 2. The frame 4 also has an apparatus for guiding and supporting the continuous cast slab 3 in a curved path from a point below the mold 2 to a point at which the slab 3*a* becomes substantially horizontal as well as suitable means for the cooling of the slab 3 during passage along the curved path. Suitable rollers are provided at the end of the path so that the slab 3*a* which is fairly cool can be supplied to other equipment for subsequent processing.

Figure 2:
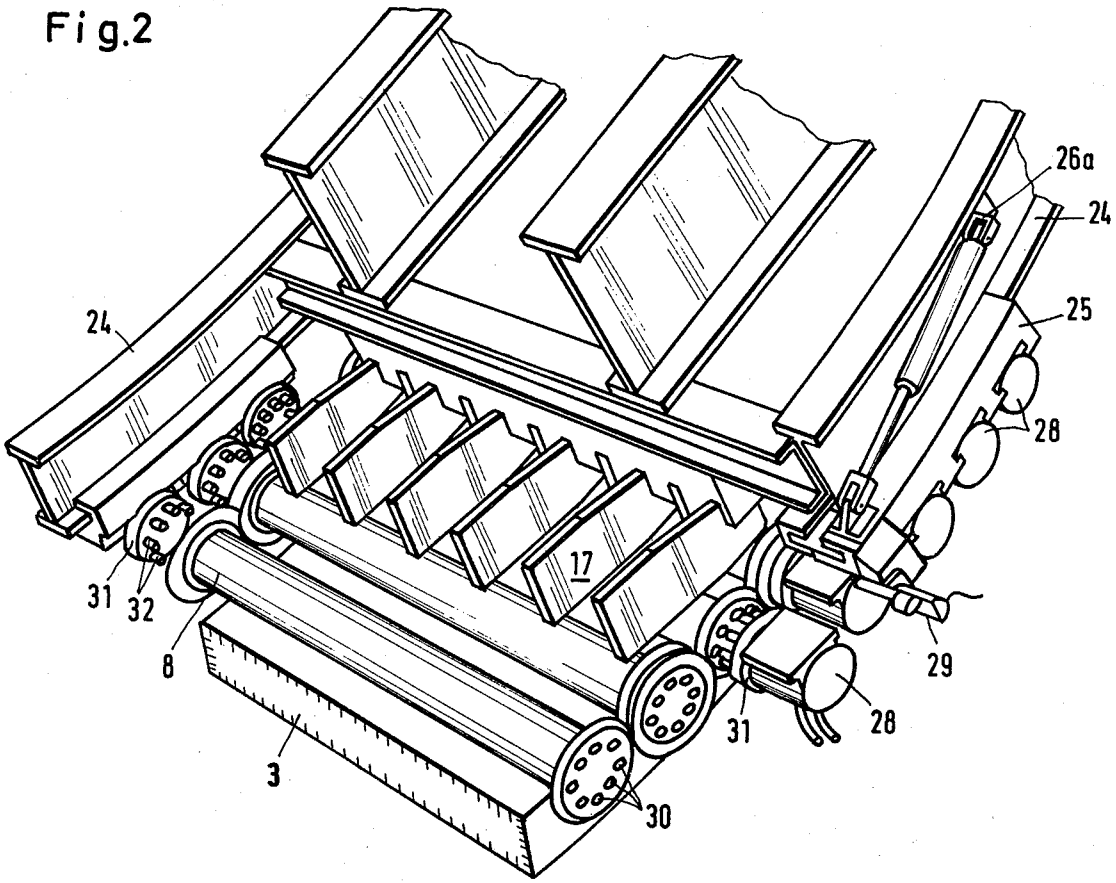
FIG. 2 illustrates a partial perspective view of a drive means according to the invention.

As shown, the apparatus for guiding and supporting the slab 3 includes a prop 5 which is firmly anchored on the frame 4 and carries an elongated support surface 6 directed towards the slab 3. The support surface 6 is curved in accordance with the curvature of the slab 3 and is composed of a plurality of laterally spaced support elements 7 (FIG. 2) which, in turn, have a plurality of rolls 8 disposed thereon in freely rolling relation in order to guide and support the slab 3 therealong. The term "freely rolling relation" means that the rolls 8 are not mounted on fixed axes but are free to roll along the support surface 6. As shown in FIG. 2, the rolls 8 are cylindrical and extend transversely across and on the support elements 7 so that the load of the slab 3 can be transferred to the support element 7. Further, the rolls 8 move freely downward without any suspension.

Referring to FIG. 2, each roll 8 has a central roll body which is substantially of cylindrical shape and may be formed, for example, by a cylindrical steel tube. Also, each end of each roll 8 carries a distance wheel.

Each of the alternating rolls 8 has distance wheels fixedly mounted on a respective end while the remainder of the rolls 8 have distance wheels rotatably mounted on a respective end via a rolling bearing (not shown). The fixedly mounted distance wheels are provided with V-shaped circumferentially projections while the rotatably mounted wheels are provided with a circumferential groove of V-shape. As indicated the respective grooves and projections of the adjacent wheels engage in each other in a mating relationship.

The construction of the distance wheels insures that pairs of adjacent rolls 8 are positively connected in alternating manner. Further, the V-shape of the mating grooves and projections of the distance wheels provide a centering effect to secure the parallel position of rolls 8 with respect to each other at a constant uniform mutual spacing from each other in the plane of slab.

Referring to FIG. 1, during operation, the downwardly-moving slab 3 rolls along the surfaces of the roll body of each roll 8 on the support surface 6 while the roll bodies roll along the support elements 7. Each individual roll 8 thus moves at a certain relative velocity to the slab 3 during downward travel. Upon reaching the lower end of the support surface 6, each roll 8 falls out of the interspace between the top of the support elements 7 and the back of the slab 3. Each roll 8 is then recycled by a suitable means back to the upper end of the support surface 6. This means includes a catch device 9, a horizontal conveyor belt 10 with drivers 11, a second conveyor belt 12 provided with drivers 13 and an insertion device 14 equipped with a ram 15. The catch device 9 is disposed to catch a falling roll 8 and to position the roll 8 onto the conveyor belt 10. The drivers 11 on the conveyor belt 10 are disposed at predetermined distances as a function of the circumferential speed of the conveyor belt 10 so as to convey each roll 8 to the vertically disposed conveyor belt 12. The drivers 13 on the conveyor belt 12 serve to carry each roll upwardly to the insertion device 14. Upon actuation of the ram 15, a roll 8 which has been positioned in front of the ram 15 is shifted horizontally into an interspace between the support elements 7 and the back of the slab 3 from above. The inserted roll 8 then rolls down the support surface 7 and the cycle begins anew.

As shown in FIG. 1, the front face of a slab 3 is supported and guided in a similar manner. To this end, the frame 4 has a carrier 16 mounted therein in known manner. The carrier 16 is provided with a curved support surface 17 which faces the support surface 6 and has a plurality of laterally spaced support elements 18 thereon. In addition, a second set of rolls 8 is disposed on the support elements 18 in freely rolling relation to guide the slab 3 therealong. These rolls 8 serve to transfer the force exerted by the slab 3 on the carrier 16 to the support elements 18. The rolls 8 on the support elements 18 are of the same construction as the rolls 8 which roll on the support elements 7 and need not be further described.

As above, a means is provided for recycling the rolls 8 to and from the support surface 17. This means includes a vertical conveyor belt 19 with drivers 20, an inclined plane 21, a waiting station 22 and an insertion member 23. During operation, the rolls 8 move with the advance of the slab 3 in the downward direction indicated. As each roll moves off the support elements 18 into a space between the elements 18 and the slab 3, the drivers 20 on the conveyor belt 19 carry the roller 8 upwardly to the inclined plane 21. Each roll 8 then moves down the inclined plane 21 to the waiting station 22. As soon as a new roll 8 is required between the slab 3 and the support elements 18, the insertion member 23 is actuated by a suitable mechanism (not shown) so as to introduce the foremost roll 8 on the inclined plane 21 into an interspace between the slab 3 and the support elements 18. The roll 8 then moves downwardly along the support element 18.

Figures 3, 4, 5:
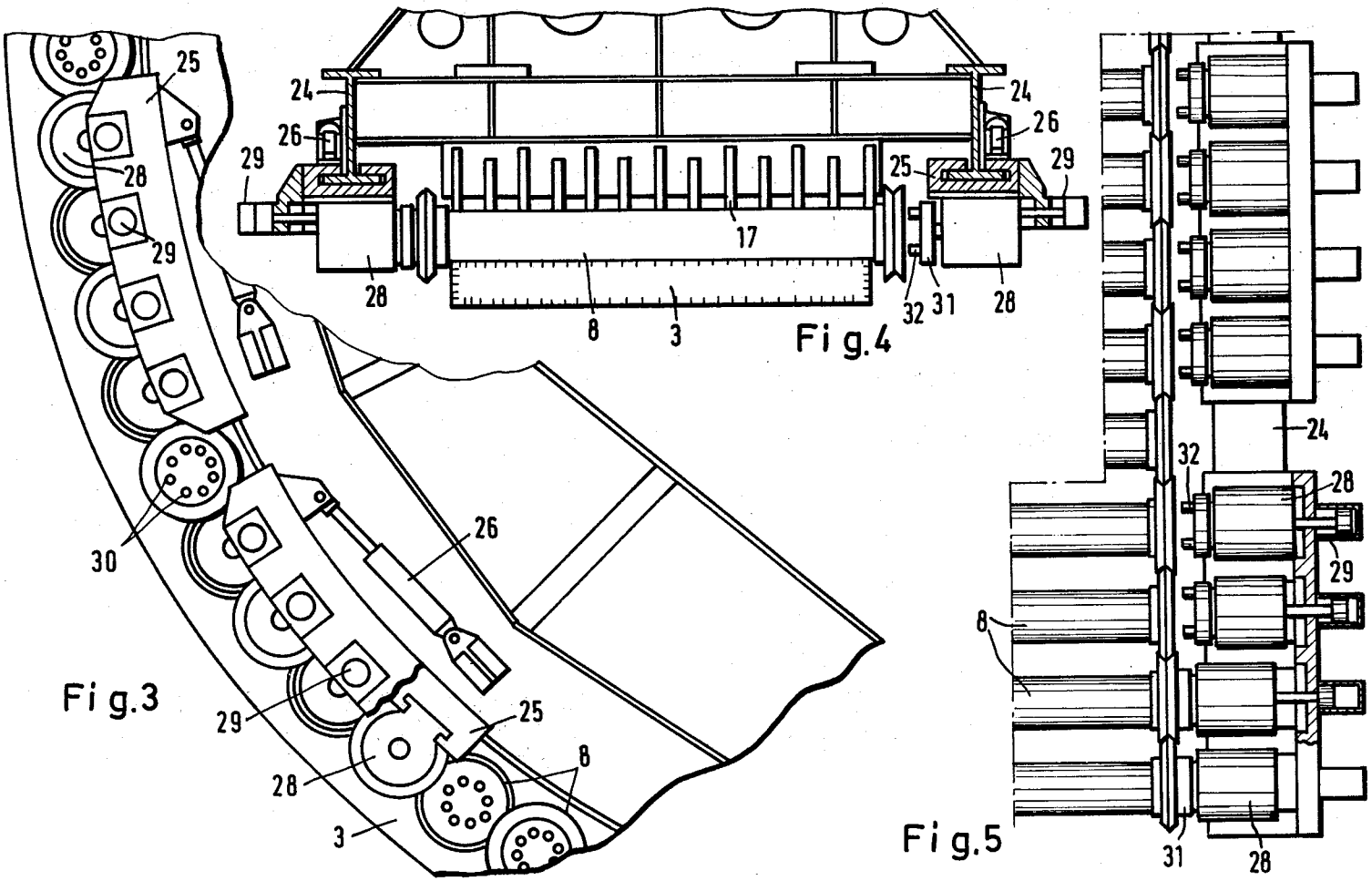
FIG. 3 illustrates a partial side view of a drive means according to the invention.
FIG. 4 illustrates a partial horizontal sectional view of the installation of FIG. 1.
FIG. 5 illustrates a partial sectional view of a drive means as viewed from above in accordance with the invention.

Referring to FIGS. 2 to 5, the continuous casting installation is also provided with a drive means along each side of the support surface 6 for releaseably engaging and rotating some of the rolls 8. To this end, each side of the frame 4 of the installation carries a guide rail 24 which is curved in accordance with the direction of slab flow to extend substantially along the entire curved portion of the slab 3. The drive means includes a plurality of slides 25 each of which is slidably mounted on a respective rail 24 and guided by means of suitable suspensions (not shown). A suitable means, in the form of a hydraulic or pneumatic piston-cylinder unit 26 is provided for reciprocally moving each slide 25 on a rail 24. As shown in FIGS. 2 and 3, the piston-cylinder unit 26 has one end **26*a* of a cylinder articulated to a guide rail 24 while the end of a piston rod 27 is articulated to a guide rail 24 while the end of a piston rod 27 is articulated with a slide 25. By alternating the pressurization of the cylinder of the unit 26 and subsequent expansion, the piston rod 27 moves in and out of the cylinder so that the slide 25** executes a reciprocating motion.

As shown, each slide 25 carries a plurality of drive motors 28, such as fluid motors, for selective coupling with a number of rolls 8. For this purpose, a suitable means, such as a piston-cylinder unit 29, is connected to each motor 28 to move the motor 28 towards the and away from the rolls 8. In this regard, only one piston-cylinder unit 29 is illustrated for simplicity in FIG. 2.

As shown in FIGS. 2 and 3, the rolls 8 each have a circular pattern of bores 30 in each end while each drive motor 28 has a rotatable flange 31 with a plurality of projecting pins 32 for selectively engaging in the bores 30. To this end, the pins 32 are of a size adapted to the bores 30 and taper conically toward the outside. A displacement of a fluid motor 28 under the influence of a piston cylinder unit 29 towards a roll 8 allows the pins 32 thereon to be introduced into the bores 30 of the roll 8 in order to couple the motor 28 to the roll 8. A reverse motion of the motor 28 retracts the pins 32 from the bores 30.

Each fluid motor 28 has a driving shaft (see FIG. 4) connected to the flange 31 so as to rotate the flange. In this regard, the drive shaft is driven for alternating forward and reverse rotation by less than 360°. That is, the driven shaft is oscillated over an angle of from 110° to 270° in intermittent manner. The motor 28 does not rotate continuously. The intermittent rotary movement of the flange 31 is accommodated since the motor 28 is to be returned to a starting position during a return motion of the slide 25 on which the motor is mounted when the motor 28 is detached from a roll 8.

Suitable pressure sources for hydraulic fluid as well as control devices for the operation of the fluid motors 28, the piston cylinder units 26 and 29 and the associated auxiliary components (not shown) are also provided. The details of the connections and the auxiliary components are not believed to be necessary since such is not necessary to an understanding of the invention.

The mode of operation of the installation will be described with respect to only one of the drive means for purposes of simplicity.

After retraction of a slide 25 via the piston-cylinder unit 26, the slide 25 is located in an upper end position. The fluid motors 28 disposed on the slide 25 are then displaced under the action of the piston-cylinder units 29 towards the downwardly moving rolls 8 until the pins 32 engage in the bores 30 of the rolls 8. Next, the fluid motors 28 are actuated to transmit a torque via the driven flanges 31 and pins 32 to the rolls 8. The rolls 8 then roll on the support elements 18 and, in so doing, transport the slab 3 downwardly. At the same time, the rolls 8 move downward at half the flow velocity of the slab 3. The slide 25 participates in this movement until reaching a lower end position. At this time, the fluid motors 28 on the slide 25 are uncoupled from the rolls 8 by retraction of the motors via the piston-cylinder units 29. The slide 25 is then returned to the upper end position via the piston-cylinder unit 26 and the entire cycle starts anew.

As viewed in FIG. 3, several slides 25 are present on both sides of the slab 3 in the interest of a uniform conveyance of the slab 3. It is advisable not to allow the feed cycle, which is itself intermittent, to take place simultaneously for all slides but to have the feed cycles take place with a suitable time stagger. In particular, only one of the slides 25 should be slid back while all the other slides 25 convey the slab 3 downwardly.

It is to be noted that the piston-cylinder units 26 do not perform a feed function. During a forward movement of the slides 25, an overflow valve in the hydraulic system to the piston-cylinder unit 26 can be opened in order to permit the free mobility of the slide 25. Likewise, a loading of the piston-cylinder unit 26 by the torque provided by the fluid motors 28 is not present as the torque is absorbed by the guide rail 24 via the slide 25.

It is also to be noted that the return movement of the slides 25 occurs substantially faster than the forward movement during conveyance of the slab 3. For example, the ratio of the return movement to the forward movement is 15:1. This assures great effectiveness of the drive in the slab but leaves enough time for a resetting of the fluid motors 28.

The use of two slides 25 with fluid motors 28 thereon permits an almost continuous advance of the slab 3. However, it would be advantageous to use at least four or more such slides. This allows the size and power of the fluid motors 28 to be reduced so that the motors can be more easily coupled to the rolls 8 or detached therefrom. Further, a large number of slides and motors benefits the continuity of the conveyance of the slab 3.

The use of fluid motors for conveyance of the slab 3 has technical as well as economic advantages. First, a fluid motor having a shaft which is drivable for forward and reverse movement is one wich provides the greatest torque at lowest costs and smallest dimensions. Second, it is very easy to control a fluid motor by regulation of the fluid pressure and has proven over time to be reliable in operation over the most unfavorable conditions.

It is to be noted that at the beginning of a stroke, when the fluid motors 28 are pressed by the piston-cylinder units 29 against the outerfaces of the rolls 8, it is not absolutely assured that the pins 32 will immediately engage in the bores 30. However, since the slab 3 is moved by the other fluid motors 28 at the same time, all the rolls 8 are in rotation. Thus, engagement of the pins 32 will occur after a brief time, whereupon the fluid motor 28 can then be actuated.

When using freely rolling rolls, the slab 3 may shift a little to the side. As the occurring forces per roll may amount to as much as 50 tons, it is not possible to correct the slab flow direction by displacement of the slab. However, a correction can be achieved by the drive means in that, for a while, the drive occurs only from one side. This can be caused by temporarily stopping the slides on the opposite sides of the slab 3.

It is to be noted that the drive means act on the rolls 8 which lie above the slab 3. Under certain circumstances, a drive only of the rolls lying under the slab or a drive of the rolls on both the upper and lower sides of the slab is possible. At any rate, the above described arrangement offers some advantages in that the drive is less exposed to contamination. Also, the adjustment of the continuous casting installation to slabs of different thicknesses to be cast can be greatly simplified.

What is claimed is:

1. An apparatus for guiding and supporting a continuously cast slab, the combination comprising a support surface;

a plurality of rolls disposed on said support surface in freely rolling completely unjournaled relation with respect to said support surface and each other to travel in a direction along said support surface and to guide a slab therealong, each said roll having an axis of rotation perpendicular to the direction of travel along said support surface;

a pair of rails, each said rail being disposed along one respective side of said support surface running in the direction of travel of said rolls;

a plurality of slides, each said slide being slidably mounted on a respective rail; and a plurality of drive motors, each said drive motor being mounted on a respective slide for selective coupling with a respective roll to drive said roll in said direction.

2. The combination as set forth in claim 1 which further comprises a piston-cylinder unit connected to a respective slide for reciprocating said slide along a respective rail.

3. The combination as set forth in claim 1 wherein each slide carries a plurality of drive motors thereon.

4. The combination as set forth in claim 1 wherein each of said rolls has a pattern of bores in each end thereof and each drive motor has a rotatable flange with a plurality of pins projecting therefrom, said pins being disposed to selectively engage in a respective pattern of bores in an end of a respective roller.

5. The combination as set forth in claim 4 which further comprises a piston-cylinder unit connected to each respective drive motor for moving said drive motor towards and away from said rolls.

6. The combination as set forth in claim 1 wherein each said drive motor is a fluid motor having a drive shaft driven for alternating forward and reverse rotation by less than 360°.

7. The combination as set forth in claim 1 which further includes means connected to each motor for moving each respective motor towards and away from said rolls.

* * * * *